United States Patent [19]

Christensson

[11] 4,154,045

[45] May 15, 1979

[54] METHOD OF PACKING POWDER FORMED PRODUCTS

[75] Inventor: Od W. Christensson, Jrafalla, Sweden

[73] Assignee: Esseltepac Aktiebolag, Jarfalla, Sweden

[21] Appl. No.: 851,409

[22] Filed: Nov. 14, 1977

[30] Foreign Application Priority Data

Nov. 17, 1976 [SE] Sweden ..... 76128347

[51] Int. Cl.[2] ..... B65B 31/02; B65B 1/24

[52] U.S. Cl. ..... 53/432; 53/436; 53/510; 53/527

[58] Field of Search ..... 53/22 R, 22 A, 22 B, 53/112 R, 24, 124 B; 100/237

[56] References Cited

U.S. PATENT DOCUMENTS

| | | | |
|---|---|---|---|
| 2,046,366 | 7/1936 | Collins | 53/24 X |
| 3,748,819 | 7/1973 | Christensson | 53/124 B |

*Primary Examiner*—Travis S. McGehee

*Attorney, Agent, or Firm*—Larson, Taylor and Hinds

[57] ABSTRACT

In a method for packing of powder formed goods in a container which is hermetically sealable under vacuum, a container blank is formed into an open topped container and a predetermined amount of powder formed product is deposited into the container. The product is slightly compacted by a piston which moves relatively slowly down into the container and presses the product at a relatively low pressure, the piston being then removed. In a second step, the product is compressed by a piston at a relatively high pressure so that the surface of the product is compressed to a level which is below the intended final level of the container. Thereafter the product is subjected to a relatively slight compression by means of a piston which, with a relatively low pressure, is pressed onto the surface of the product. In this third compression step, the relatively low pressure may be followed by a momentary thrust of the piston at a higher pressure. Thereafter the container and the compressed product are subjected to vacuum, and the container is sealed hermetically under vacuum.

9 Claims, 2 Drawing Figures

METHOD OF PACKING POWDER FORMED PRODUCTS

Figure 1:
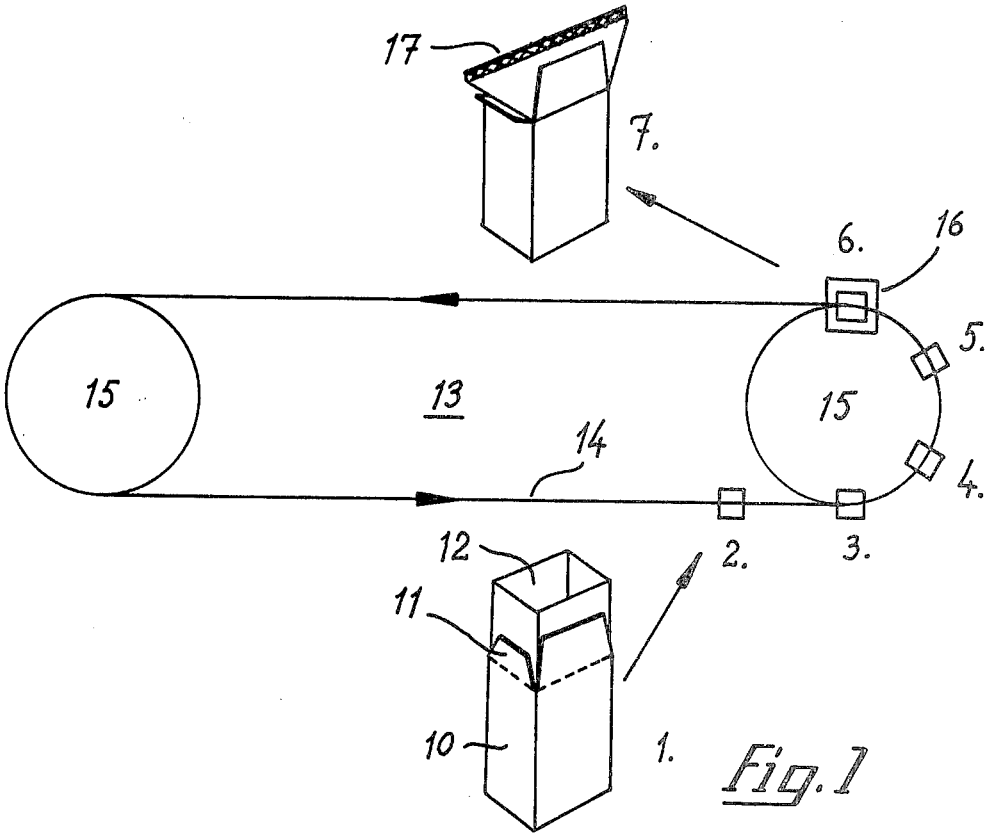

The present invention relates to a method and an apparatus for packing of powder formed products in a container of a pliable and easily formable material. The invention is in particular directed to a packaging method in which the powder formed product to be packed after having been filled into the container of the pliable and easily formable material is subjected to a mechanical compressing, and the container including the powder formed product is subjected to a vacuum treatment whereby the content of air in the container is reduced as far as possible, whereupon the container is hermetically sealed.

In a previously proposed method the powder formed product is filled in a relatively stiff container, whereupon a piston under high pressure is forced onto the surface of the powder formed product so that said goods is mechanically compressed and the surface of the product to be packed is pressed down to a level under or adjacent the intended upper surface of the container which is about to be formed, and just following the said mechanical compression the container is subjected to a vacuum treatment and is formed with a sealing foil which hermetically encloses the compressed and vacuum treated goods. As compared with conventional packing of powder formed goods the said previously proposed method is advantageous in that the goods to be packed by the compressing can be pressed down so far into the container that the product does not shrink to any noticable extent during the vacuum treatment and it is consequently possible to form the container so that the packed product completely fills the container and a compact container having substantially completely even upper side and under side is obtained.

The pressure to provide the mechanical compression of the goods to be packed must be relatively high and the method therefore necessitates a relatively stable container and packing machine and therefore the method has not been considered suitable for such conventional containers which are made of a casing of cardboard or similar stiff material having an inner lining of a thin and easily formable material like plastic and in which the lining is generally sealed by a plane sealing. In order to avoid that the powder formed product during the compression is pressed up from the container beside the compressing piston depending on the movement thereof the compression must not be made too rapidly and the compression therefore takes longer time than what is normally available in conventional packing machines of the type in which the container is step by step fed to different stations for filling, closing and sealing etc. Therefore the method has not been considered suited for such conventional packing machines.

The packing of powder formed product in conventional containers and by means of conventional packing machines is generally made in that the product is filled in the container, sometimes while vibrating the container, whereupon the container by being moved step by step on a carousel or a conveyor is vacuum treated, closed and sealed. The said vibration may provide some compacting of the powder formed product but not to such extent as to avoid a shrinking of the lining and the product when the pressure after the vacuum treatment is increased. Depending on such shrinkage or contraction is that a substantial amount of air is obtained between the outer container and the filled and sealed lining, and the said air space has as an effect that the completed container is not especially compact and that the outer container must be made somewhat larger than what is justified considering the final volume of the vacuum treated lining.

The object of the invention is to provide a method and an apparatus for packing powder formed goods so that the outer container can be made with such volume that the vacuum treated lining including the powder formed product practically completely fills the outer container, which both involves the advantage that the necessary amount of the expensive outer container material can be reduced and that the total volume of the container is less than what has previously been possible, which in turn makes the following handling and the storing simplified and less expensive, and that a compact container is obtained, which is easy to file and pack since both the upper side and the under side of the container are well supporting.

According to the invention the said problem is solved by a combined compressing and vacuum treatment of the packed goods, whereby the compressing is made in at least three successive steps in a particular manner, each step being accomplished during the short period of time which is available in each still standing moment of the container.

Figure 2:
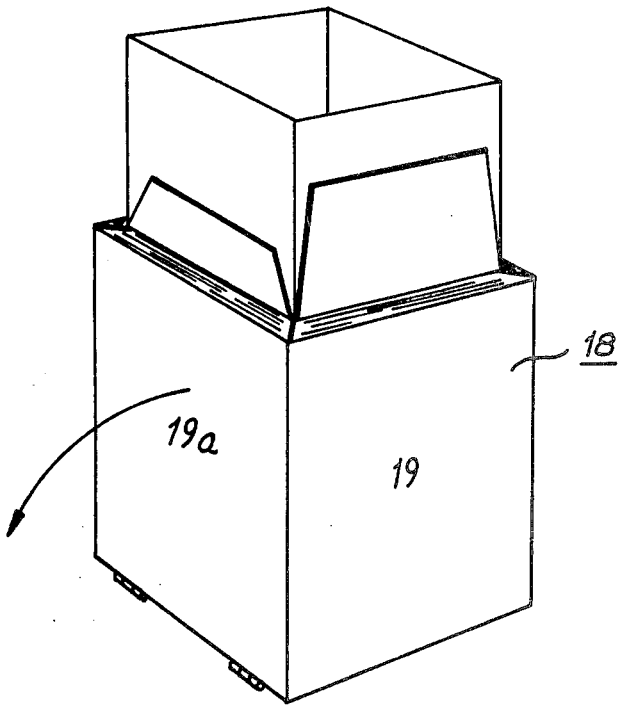

The invention is now to be discribed more in detail with reference to the accompanying drawings in which FIG. 1 diagrammatically shows a plant according to the invention for executing the method and FIG. 2 shows a detail of the said apparatus.

The method according to the invention can be executed in six or seven successive steps, and the invention will be described with reference to a method including several steps as shown in FIG. 1 of the drawings, and the said steps are identified by the reference numbers 1–7.

The powder formed product goods which is intended to be packed can be any kind of material which while falling down encloses a substantial amount of air, and as examples of material can be mentioned flour, grain, coffee and similar material. The container is a conventional container of the kind which comprises an outer container 10 of cardboard or similar stiff material which is supplied in the form of a plain punched cardboard material and which at both ends is formed with closer flaps 11 and which contains a lining 12 of a thin and easily pliable material, preferably a weldable material like plastic.

Step 1. In the first step the outer container 10 and the lining 12 are opened as a container tube which is closed at one end which may be the lower end or the upper end of the ready container. The lining 12 is generally higher than the outer container 10 including the closure flaps 11 for facilitating the filling of the goods to be packed and the handling and sealing of the container. The opening and sealing of said one end of the container can be made separately or in a packaging machine 13 of the type in which containers are fed step by step to different stations by means of a conveyor of priorly known kind. In FIG. 1 the packaging machine is generally illustrated as an endless conveyor 14 extending round to carousel wheels 15 but it is to be understood that the machine may be formed as one single carousel or it may be any other type of priorly known apparatus. It is a general attempt to get the packaging machine as rapid working as possible and in modern machines it is calculated that it shall be possible to fill and close sixty containers or more per minute. This means that no more than one second at a maximum is available for handling and moving the containers between each step corresponding to the steps 1–7 of FIG. 1, and of this time the container is stillstanding and allows a handling during 0,5–0,6 seconds at a maximum whereas the movement of the container between the different stations takes the remaining time.

Step 2. In the second step a predetermined amount of the products to be packed is to be filled into the container. The filling station may be separate or may be directly connected to the conveyor 14 and it is generally formed as a portioning device having a balance so that always a predetermined amount by weight of the product is filled into the container. Preferably the container is vibrated during the filling so that some compacting of the product is provided during this step.

Step 3. After the container is moved to the third station the actual compressing starts, and this is made in that a piston under relatively slow movement is moved down into the interior of the lining 12 thereby providing a slight compressing of the goods. It is essential that the movement of the piston is relatively slow within the possibility of the short period of 0,5–0,6 second which is available, and it is also essential that the compressing in this step is made with a relatively weak force since at high piston speed and high compression force there is a risk that the products which is filled in the lining is ejected upwards between the compression piston and the lining thereby disturbing the continued treatment aside from the fact that the container thereafter contains less goods than what is intended. The light compression in this third step can be made by an over pressure on the surface of only 0,1–0,4 kg/cm$^2$ or even still lower force. What is essential is that the running surface material which is present after the filling and the vibrating of the preceding step is somewhat compressed to prevent an ejecting upwards thereof or any other disturbance for the following step.

Step 4. In this step like in the preceding step, a compression is made preferably by means of a plain piston which is moved down into the lining and is pressed to the surface of the goods to be packed. The movement of the piston in this step can be substantially higher than in the preceding step and in this forth step the compressing shall be made by a high pressure. Generally the surface pressure during the compression in this step should be substantially higher than the corresponding negative pressure which is provided during the following vacuum treatment. When compressing such products as coffee a surface over pressure of 1,4–2,0 kg/cm$^2$ or preferably 1,6–1,8 kg/cm$^2$ is considered suitable. The compression in this step provides a forcing down of the upper surface of the goods to be packed so that said surface takes a level substantially under the intended upper side of the ready container, but depending on the fact that the products to be packed resiliently moves slightly back again when the compressing piston is moved the surface of the packaging products thereby moves slightly up, but still it keeps a level under the intended upper surface level of the ready container. When the compressing piston is raised from the surface of the packaging goods and is withdrawn from the lining 12 some restructuring can occur especially at the surface layer of the packaging goods at the same time as grains of the packaging goods may be released depending on the return movement of the piston.

Step 5. In order to once again compress the surface of the packaging goods after a possible restructurization of the surface layer and to press down any particles of the goods which may remain loose a slight compression of the surface of the packaging goods is made in this fifth station, also in this case by means of a piston which is moved down into the lining 12. Also in this station the compression may be made with a relatively low pressure but in some cases it may show suitable during this last mentioned compression to slightly increase the pressure momentary to provide a thrust action on the packaging goods. The main pressure in this fifth step can be relatively low, for instance an overpressure of 0,1–0,4 kg/cm$^2$, whereas an overpressure of 0,3–0,7 kg/cm$^2$ can be allowed as the said momentary thrust pressure.

Step 6. From the fifth station in which the packaging goods is mechanically compressed in a third successive the container is moved to a vacuum chamber 16 in which the entire container comprising the outer container the lining and the packed goods is subjected to a strong vacuum, for instance 96–98% vacuum, whereby practically all remaining air is sucked out of the container. Still during vacuum the lining is closed in any suitable way, for instance by welding the upper end thereof by a plane closure rib 17.

Step 7. From the vacuum chamber 16 the partly closed container is moved to a sealing station in which the lining is folded together and the closure flaps 11 are glued or welded together to provide a ready container.

It is obvious that the material which is filled in the container during the first step and which contains a substantial amount of air or when filling in a gas atmosphere a substantial amount of gas fills the inner of the container lining 12 to a level which is essentially higher than the intended final upper level of the outer container, and to prevent the lining or the outer container from being upset or pressed together during the mechanical compression it may in some cases be suitable or necessary to keep the container in a casette during the entire treatment. One example of such casette is shown in FIG. 2. The said casette 18 is formed with bottom and four sides 19 one or more sides **19*a* of which is openable. During the treatment in the above described stations 2, 3, 4 and 5 the casette 18** is kept as a closed unit supporting the container at all four sides and the bottom so that the container keeps its form even at strong mechanical compression. The casette may be higher than the intended upper side of the outer container and it may even be made high enough to reach an upper level which is the same as or which may even be higher than the level of the goods which is filled into the lining but not yet compressed.

The casettes 18 are preferably mounted on the conveyor 14 and the container is provided in the casette before or directly after the filling of the packaging goods, and the casette thereafter follows the container at least in the stations 2–5 and if found suitable even until the container leaves the vacuum chamber 16.

In a particularly preferred method according to the invention the casette 18 is kept closed in stations 2, 3 and 4 as mentioned above, but in station 5, in which the third and final compression with a relatively low pressure is made which may be followed by a momentary thrust pressure the openable side or sides **19*a* of the casette can be kept open, which has shown advantages to provide a good forcing down of the packaging goods to the bottom and along all edges and corners of the container. The openable side or sides 19** are kept opened also during the vacuum treatment.

The pistons which are used for the mechanical compression and any other means of the apparatus can be of a kind known per se, for instance double acting hydraulic or pneumatic cylinders in which the press piston is mounted on the piston rod of the hydraulic cylinder.

In the preceding the method according to the invention is described with reference to a container comprising an outer container and a lining. It should be noted that the method is however as well suited for handling of a container comprising one single layer of material or a multi-layer laminate supposing that the said one layer material can be closed and sealed hermetically in a vacuum chamber. In the latter case the operation in station 7 is restricted to folding the container ears in and sealing the container by the flat close rib 17 and if found suitable sealing of the projecting container ears.

It is to be understood that the above described method and apparatus is only an illustrating example and that the method and the apparatus can be modified in a way which is obvious to the expert within the scope of the appended claims.

We claim:

1. A method for packing of powder formed goods in a container which can be sealed hermetically under vacuum, comprising forming a container which is open at the top, filling the container with a predetermined amount of powder formed goods, slightly compacting the goods in a first compression step by moving a piston relatively slowly down into the container and pressing onto the surface of the goods with a relatively low pressure, removing the piston, pressing a piston to the surface of the slightly compacted goods with a relatively high pressure in a second compression step so as to compress the goods to a level below the intended final level of the container, removing the piston, slightly compressing the surface of the goods in a third compression step by moving a piston down into the container and with a relatively low pressure against the surface of the goods which may have been restructured after the relatively strong second compression step, removing the piston, subjecting the container and product to a vacuum, and sealing the container hermetically under vacuum.

2. A method according to claim 1 wherein the compacting of the goods in the first compression step is at a surface pressure of about 1.1 to 1.4 kilograms per square centimeter.

3. A method according to claim 2 wherein the compression at the second compression step is at a surface pressure of about 1.4 to 2.0 kilograms per square centimeter.

4. A method according to claim 3 wherein the third compression step is at a surface pressure of about 1.1 to 1.6 kilograms per square centimeter.

5. A method according to claim 1 wherein during the third compression step the pressure is increased momentarily to provide a thrust load before the piston is removed from the container after the third compression step.

6. A method according to claim 1 wherein the container is vibrated while being initially filled with the goods.

7. A method according to claim 1 wherein the container is mounted in a cassette before the first compression step, which cassette has a bottom and sides, and the container remains standing in the cassette during the compression steps.

8. A method according to claim 7 wherein at least one side of the cassette is opened during the third compression step.

9. A method according to claim 1 wherein the container is moved by an intermittently driven conveyor, and the different compression steps and the vacuum treatment are made during stationary periods of the conveyor.

* * * * *